United States Patent [19]

Moss

[11] 4,407,199

[45] * Oct. 4, 1983

[54] MANDREL ASSEMBLY FOR DEMOUNTABLE PRINTING CYLINDERS OF DIFFERENT LENGTHS

[75] Inventor: Lester I. Moss, Hackensack, N.J.

[73] Assignee: Mosstype Corporation, Waldwick, N.J.

[ * ] Notice: The portion of the term of this patent subsequent to May 17, 2000 has been disclaimed.

[21] Appl. No.: 292,129

[22] Filed: Aug. 12, 1981

Related U.S. Application Data

[63] Continuation-in-part of Ser. No. 207,976, Nov. 18, 1980, which is a continuation-in-part of Ser. No. 194,616, Oct. 6, 1980.

[51] Int. Cl.[3] ..... B41F 27/06

[52] U.S. Cl. ..... 101/375; 29/113 R

[58] Field of Search ..... 101/375, 376; 29/113 R, 29/113 AD, 117, 123, 129, 129.5; 242/72 R, 72 B; 279/2 A; 269/48.1

[56] References Cited

U.S. PATENT DOCUMENTS

| | | | |
|---|---|---|---|
| 1,600,692 | 9/1926 | Millspaugh | 101/375 |
| 2,583,117 | 1/1952 | Piperoux et al. | 29/113 R |
| 2,787,956 | 4/1957 | Kirby et al. | 101/375 |
| 2,797,604 | 7/1957 | Atherholtt et al. | 279/4 |
| 2,876,961 | 3/1959 | Cole et al. | 242/72 |
| 2,949,852 | 8/1960 | Schaefer | 101/375 |
| 3,166,013 | 1/1965 | Wyllie et al. | 29/113 R |
| 3,202,432 | 8/1965 | Cameron | 242/72 X |
| 3,217,554 | 11/1965 | Stalker | 29/129.5 X |
| 3,253,323 | 5/1966 | Saueressig | 29/113 R |
| 3,378,902 | 4/1968 | Hoexter | 29/156.4 R |
| 3,388,916 | 6/1968 | Winnen et al. | 279/2 |
| 3,535,760 | 10/1970 | James | 29/113 R |
| 3,762,730 | 10/1973 | Cameron | 242/72 B X |
| 3,770,287 | 11/1973 | Weber et al. | 242/72 |
| 4,050,643 | 9/1979 | Secor | 242/72 R |
| 4,135,677 | 1/1979 | Warczak | 242/72 B |
| 4,147,312 | 4/1979 | Secor et al. | 242/72 R |
| 4,150,622 | 4/1979 | Stollenwerr et al. | 29/113 R X |
| 4,217,821 | 8/1980 | Vertegaal | 101/375 X |

FOREIGN PATENT DOCUMENTS

| | | | |
|---|---|---|---|
| 2,815,892 | 9/1979 | Fed. Rep. of Germany | 29/113 R |

*Primary Examiner*—J. Reed Fisher

*Attorney, Agent, or Firm*—Michael Ebert

[57] ABSTRACT

A mandrel assembly for supporting demountable printing cylinders of different lengths. The assembly includes a tube receivable within the cylinder to be mounted and having journals joined thereto at either end. Encircling each journal are first and second expansible sleeves in side-by-side relation, the first set of sleeves fitting within the end heads of the shorter cylinder when it is mounted on the mandrel assembly, the second set of sleeves fitting within the end heads of the longer cylinder. Below each sleeve on the journal is a relieved zone defining an annular hydraulic chamber. A bore in the journal receives a piston and a tool-operated piston screw, the bore leading into an internal duct having a branch communicating with the hydraulic chamber. When the piston screw is turned in to advance the piston, the resultant hydraulic pressure is applied through the hydraulic chamber against the inner wall of the sleeve, causing the sleeve to expand and grip the cylinder head, thereby locking the cylinder to the mandrel assembly. When the piston screw is turned out, the pressure is released to permit removal of the cylinder.

5 Claims, 2 Drawing Figures

MANDREL ASSEMBLY FOR DEMOUNTABLE PRINTING CYLINDERS OF DIFFERENT LENGTHS

RELATED APPLICATIONS

Figure 1:
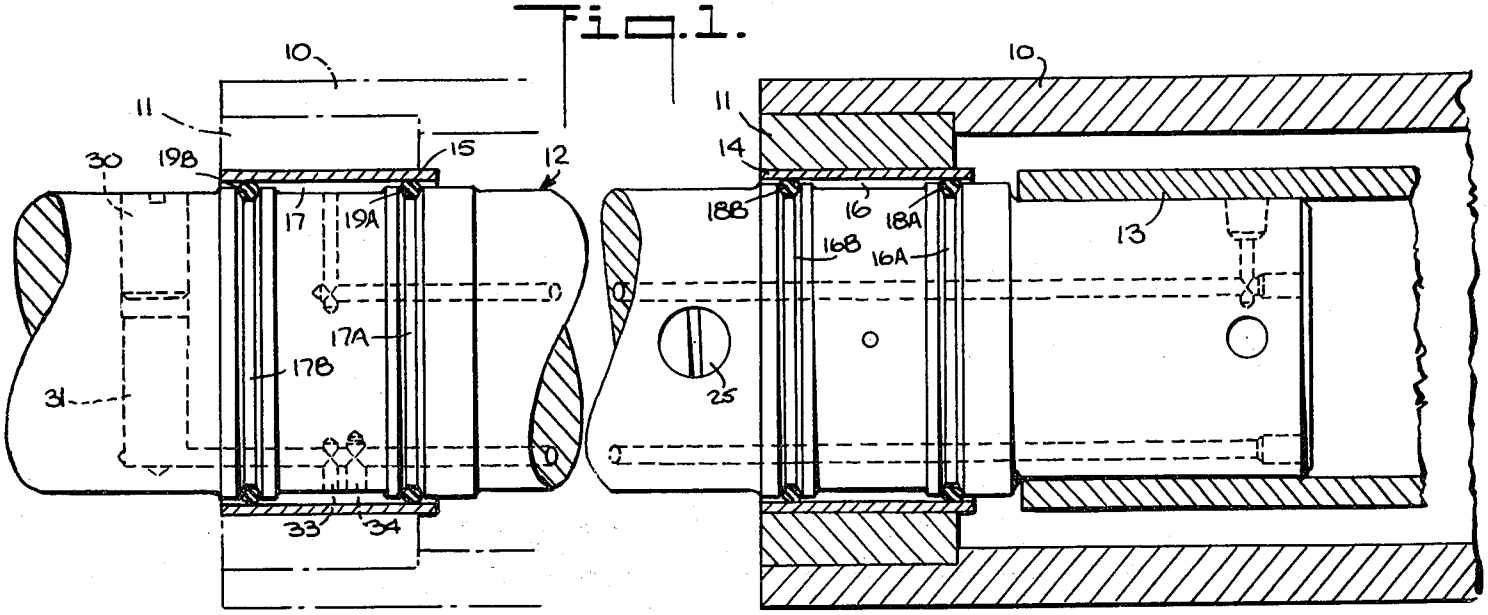

This application is a continuation-in-part of my copending application Ser. No. 207,976, filed Nov. 18, 1980, entitled "Mandrel Assembly for Demountable Printing Cylinder," which in turn is a continuation-in-part of my original application Ser. No. 194,616, filed Oct. 6, 1980, entitled "Hydraulically-Actuated Mandrel for a Demountable Printing Cylinder," the entire disclosures of these pending applications being incorporated herein by reference.

BACKGROUND OF INVENTION

This cylinder relates generally to demountable printing cylinders, and more particularly to a mandrel assembly for supporting demountable cylinders of different lengths.

In gravure printing, use is made of a printing cylinder whose surface is etched with cup-like cells which, as the cylinder passes through an ink fountain, pick up and carry the ink. When the cylinder engages an impression roller, the ink is transferred to the surface of the paper running therebetween. Flexographic printing uses similar inks, but the ink is picked up by rubber printing plates attached to a cylinder.

Since in the course of such printing operations, it is frequently necessary to replace one cylinder by another, various expedients have heretofore been proposed to provide demountable cylinder structures whereby the same mandrel may be coupled to different cylinders for use in the printing machine.

The simplest mechanical expedient for this purpose is set-screws to attach a cylinder to the mandrel. While set-screw arrangements are uncomplicated, they have many serious practical drawbacks. It is difficult to achieve proper concentricity with set screws; and as a consequence, the printing is of poor quality. Moreover, set-screws tend to vibrate and work loose. Other more complicated mechanical locking devices, such as split-lock clamping collars and expanding collets, have been suggested, but these are generally more expensive and equally inaccurate.

One may obtain accurate mounting for printing cylinders using a heat-shrinkage procedure to attach and detach a cylinder to or from a mandrel. This procedure involves end closures on the cylinder having a relatively high coefficient of thermal expansion with respect to the mandrel, and it requires special heating equipment. Not only is the procedure time-consuming, but should axial or side-to-side adjustment of the cylinder on the mandrel be necessary, the heating procedure must be repeated with a further loss of time.

Another known approach makes use of hydraulically-actuated collet locks for demountable cylinders. However, known devices of this type require grease guns to pump fluid into the lock each time a locking action is to be effected, the grease being bled off each time the mandrel is to be released. The use of grease in the environment of printing operations is obviously undersirable. Moreover, it is not possible with such known devices to determine, without the use of additional expedients, the amount of hydraulic pressure that is being imposed on the mandrel, and whether it is sufficient to afford adequate torque resistance. As a consequence, cylinder creep or slippage may be encountered in the course of printing, with deleterious effect.

The Hoexter U.S. Pat. No. 3,378,902 discloses a printing cylinder having a pair of hydraulically-actuated collets mounted at opposing ends thereof, the mandrel for supporting the cylinder being slidably receivable within the collets and securely locked thereto when hydraulic pressure is applied. Each collet includes a cylindrical sleeve having a thick-walled hub section and a relatively long thin-walled pressure section. A broad circumferential channel is cut in the pressure section to form a bendable pressure wall, the pressure section being surrounded by a collar of high tensile strength whose edges are welded to the pressure section to define an annular fluid chamber bounded by the collar and the pressure wall.

A pressure cartridge is fitted into a cavity in the hub section, the cartridge communicating with the fluid chamber in the pressure section and including a piston which is advanced inwardly by an adjusting screw. When the annular chamber is filled with hydraulic fluid and the piston is advanced inwardly, the resultant hydraulic pressure causes flexure of the pressure wall, thereby subjecting the mandrel to radially-directed stresses which are uniformly distributed and serve to lock the mandrel to the collet and at the same time to maintain proper concentricity.

In the Hoexter arrangement, the mandrel is a standard shaft, but the demountable cylinder is not of standard design. It is a special cylinder which includes a pair of hydraulically-actuated end collets, as described above. Hence the special cylinder is substantially more expensive to manufacture than a standard cylinder. Since each machine in the printing facility is provided with several special cylinders each operable with a common mandrel, the overall cost of this arrangement is high.

In my above-identified copending applications, there is disclosed a mandrel assembly for use with a standard demountable printing cylinder, which assembly includes quick-acting hydraulically actuated expansible sleeves adapted to produce a uniform outward pressure throughout its circumference to engage the end heads of the printing cylinder, whereby distortion of the cylinder is avoided and proper concentricity is maintained. A significant feature of this mandrel assembly resides in a self-sufficient and sealed hydraulic system which produces a cylinder locking action by turning a piston screw, a release action being obtained simply by reversing the direction of turn, no external source of hydraulic fluid being required.

In my copending application Ser. No. 207,967, the actuating piston for the hydraulic system which acts on the expansible sleeve is disposed in the inlet section of a duct filled with hydraulic fluid which extends axially in the journal. In my copending application Ser. No. 194,616, the actuating piston is disposed in a lateral bore in the journal which joins an internal duct therein filled with hydraulic fluid. In either case, operation of the piston results in expansion of the sleeve to grip the related end head of the printing cylinder.

The mandrel assemblies of the type disclosed in my copending applications each operate in conjunction with printing cylinders having a length for which which the assembly is specifically designed. Thus if the printing cylinder is, say, 36 inches long, then the mandrel assembly dimensions must be such that the gripping sleeves thereon telescope within the bores of the end heads of this cylinder. A mandrel assembly of these dimensions cannot, therefore, be used with a longer printing cylinder; and for this purpose, another mandrel assembly is is required.

SUMMARY OF INVENTION

In view of the foregoing, the main object of this invention is to provide a mandrel assembly capable of supporting either of two demountable printing cylinders, one being longer than the other, thereby obviating the need for separate assemblies for this purpose and effecting a significant cost saving.

More particularly, it is an object of this invention to provide a mandrel assembly of the above type in which there is included two hydraulic systems which are independent of each other and operate without mutual interference; one system serving to lock the shorter printing cylinder on the assembly and the other system locking the longer printing cylinder.

Thus a mandrel assembly in accordance with the invention has all of the advantages of the assemblies disclosed in my copending applications plus the further advantage of being able to support printing cylinders of two different standard lengths.

Briefly stated, a mandrel assembly in accordance with the invention includes a tube receivable with a printing cylinder to be mounted in the cylinder having end heads provided with bores. Joined to the opposite ends of the tube is a pair of journals, each journal being encircled by first and second expansible sleeves, the first set of sleeves on the pair of journals being positioned thereon to fit within the bores of the end heads of a long standard printing cylinder, the second set of sleeves being positioned to fit within the bores of the end heads of a shorter cylinder.

Each of the sleeves on the journal surrounds a respective annular hydraulic chamber formed on the journal, each chamber communicating with an internal duct in the journal filled with hydraulic fluid and terminating in an inlet section having a piston screw thereon which is accessible from the exterior of the journal, whereby when the piston is screwed in, the resultant hydraulic pressure is transmitted through the chamber to the associated sleeve to cause expansion thereof, whereby the sleeve then grips the end head to lock the cylinder to the mandrel.

OUTLINE OF DRAWINGS

Figure 2:
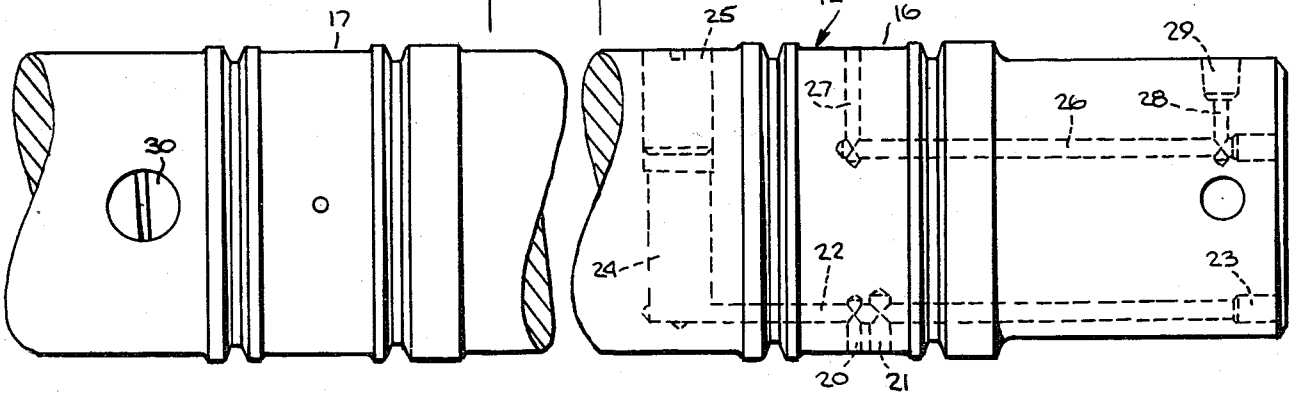

For a better understanding of the invention as well as other objects and further features thereof reference is made to the following detailed description to be read in conjunction with the accompanying drawings, wherein:

FIG. 1 shows one of the journals of a mandrel assembly in accordance with the invention and one of the two hydraulic systems included therein; and FIG. 2 shows the same journal and the other of the two hydraulic systems.

DESCRIPTION OF INVENTION

Referring now to FIG. 1, there is shown a gravure or flexographic printing cylinder 10 releasably mounted on a mandrel assembly accordance with the invention. The assembly includes left and right journals which are received in suitable bearings in the printing machine for which it is intended. Cylinder 10 is of standard design and is uniform circular cross section, the cylinder being provided at either end with an end head 11. In FIGS. 1 and 2, only the left journal 12 is shown.

In the mandrel assembly, the leading section of the journals is shrunk fit into opposite ends of a metal connecting tube 13. Since my copending application shows left and right journals in conjunction with a connecting tube, for present purposes, it is sufficient to show only the left journal 12; for the right journal is structurally and functionally identical thereto.

Journal 12 is encircled by two expansible sleeves 14 and 15, preferably fabricated of steel, the sleeves being in side-by-side relation on the intermediate section of the journal. The parameters are such as that the outside diameter, each sleeve is substantially equal in the unexpanded state to the bore in the end head of the printing cylinder.

Sleeve 14 is adjacent to tube 13, its position being such as to fit into the bore of the end head 11 of a cylinder 10 of relatively short standard length such as a 36-inch long printing cylinder. Sleeve 15 is spaced from sleeve 14 to occupy a position at which it will fit into the bore of the end head of a longer cylinder, such as one having a 42-inch length. The same mandrel assembly may therefore by used for cylinders of either length.

Journal 12 is machined to relieve zones underlying sleeves 14 and 15 to define annular hydraulic chambers 16 and 17. On either side of chamber 16 are annular grooves 16A and 16B occupied by O-rings 18A and 18B, which are compressed by sleeve 14 to provide seals preventing oil leakage when the sleeve is expanded. Similarly, chamber 17 is flanked by annular grooves 18A and 18B occupied by O-rings 19A and 19B. Sleeves 14 and 15 are each retained on the journal by a set of three pins (not shown) at equi-angular positions in a manner disclosed in my copending applications.

Chamber 16, as shown in FIG. 2, communicates through branch lines 20 and 21 with an internal main duct 22 in the journal which is filled with hydraulic fluid. Main duct 22 runs toward the right to the front end of the journal where it is closed by a plug 23. Duct 22 runs toward the left toward a lateral bore 24 in the journal whose inlet section is occupied by a piston screw 25 which is accessible to an operator.

Also formed in the journal is a bleed duct 26 which runs parallel to the main duct. The right end of the bleed duct communicates with annular chamber 16 through a branch line 27, the other end of the bleed duct leading to a slide line 28 plugged by a stopper 29.

Thus the hydraulic system for chamber 16 is balanced. When the system is first charged, the stoppers are removed to unseal the fluid lines to permit the flow of fluid until all air is expelled from the lines, after which the stopper is put back in place.

Thereafter, by turning screw 25, the resultant hydraulic pressure is transmitted to hydraulic chamber 16 to cause expansion of sleeve 14 which acts to grip cylinder head 11 to lock the cylinder to the mandrel.

Hydraulic chamber 17 associated with sleeve 15 is of the same design as that associated with sleeve 14 and includes a piston screw 30 operating in a lateral bore 31 leading into a main duct 32 provided with branches 33 and 34 communicating with chamber 17. The operation of the hydraulic system for sleeve 15, which is used for longer printing cylinders, is independent of the system for sleeve 14 for the shorter cylinder.

In the arrangement shown in the figures, the piston for the two hydraulic system both operate at right angles to the axis of the journal. In practice, the outermost sleeve 15 may be hydraulically actuated with a system of the type disclosed in my copending application Ser. No. 207,976, in which there is a straight line arrangement for the fluidic system with the piston screw in an inlet section on the axis of the journal.

Thus the three-piece mandrel assembly in accordance with the invention has a pair of journals, each of which has first and second expansible sleeves positioned for printing cylinders of different length.

While there has been shown and described a preferred embodiment of a Mandrel Assembly for Demountable Printing Cylinders of Different Lengths in accordance with the invention, it will be appreciated that many changes and modifications may be made therein without, however, departing from the essential spirit thereof.

I claim:

1. A mandrel assembly for supporting either a long or a short standard printing cylinder in a printing machine having bearings, each cylinder having annular end heads projecting radially inward from the inner surface of the cylinder at either end thereof provided with circular bores coaxial with the cylinder anr being demountable on said assembly, said assembly comprising:

A. a tube receivable within the cylinder to be mounted;

B. left and right journals joined to opposing ends of the tube and extending axially therefrom for insertion in said machine bearings, each journal having first and second expansible sleeves thereon in side-by-side relation, the first sleeve fitting into the bore of an end head of the short cylinder, the second sleeve fitting into the bore of an end head of the long cylinder, each sleeve surrounding an annular hydraulic chamber formed on the journals; and C. first and second hydraulic systems associated with the chambers for said first and second sleeves, each system including an internal longitudinal duct in the journal filled with hydraulic fluid and communicating with the related chamber, and means to subject the fluid to pressure to effect expansion of the related sleeve.

2. A mandrel assembly as set forth in claim 1, wherein each journal has a leading section shrunk fit into and end of the tube.

3. A mandrel as set forth in claim 1, wherein said hydraulic system includes a bore in the journal which leads into the duct and a piston screw turnable to create said pressure.

4. A mandrel as set forth in claim 3, wherein said journal bore is at right angles to the duct.

5. A mandrel as set forth in claim 1, wherein said annular chamber is defined by a relieved portion of the journal, said journal having grooves on either size of the chamber occupied by "O" rings to effect a seal preventing leakage of the fluid when the sleeve is expanded.

* * * * *

UNITED STATES PATENT OFFICE

CERTIFICATE OF CORRECTION

Patent No. 4,407,199 Dated October 4, 1983

Inventor(s) Lester I. Moss

It is certified that error appears in the above-identified patent and that said Letters Patent are hereby corrected as shown below:

Column 5, line 24, change "anr" to --and--

Column 6, line 16, change "and" to --an--;
line 20, after "turntable" insert --in the bore--

Signed and Sealed this

Nineteenth Day of June 1984

[SEAL]

Attest:

GERALD J. MOSSINGHOFF

Attesting Officer

Commissioner of Patents and Trademarks